US006148157A

United States Patent [19]

Wayman

[11] Patent Number: 6,148,157

[45] Date of Patent: Nov. 14, 2000

[54] HYBRID SCAVENGELESS DEVELOPMENT USING A FAILURE MODE DETECTION SYSTEM

[75] Inventor: William H. Wayman, Ontario, N.Y.

[73] Assignee: Xerox Corporation, Stamford, Conn.

[21] Appl. No.: 09/425,922

[22] Filed: Oct. 25, 1999

[51] Int. Cl.[7] ..... G03G 15/00; G03G 15/08

[52] U.S. Cl. ..... 399/31; 399/266

[58] Field of Search ..... 399/9, 29, 31, 399/53, 61, 266

[56] References Cited

U.S. PATENT DOCUMENTS 5,134,442 7/1992 Folkins et al. ..... 399/29

*Primary Examiner*—Joan Pendegrass
*Attorney, Agent, or Firm*—Lloyd F. Bean, II

[57] ABSTRACT

An apparatus for developing a latent image recorded on a surface, including a housing defining a chamber storing a supply of developer material comprising toner; a toner donor member spaced from the surface and being adapted to transport toner to a region opposed from the surface; an electrode member spaced near the surface of a donor roll, said electrode member being electrically biased by a power supply to detach toner from said donor member as to form a toner cloud for developing the latent image; and a current signature analysis system, in communication with said power supply, for sampling an instant current signature being supplied to said electrode member; and a comparator, in communication with said current signature analysis system, for comparing said instant current signature to a plurality of preset fault signatures, said comparator including means for generating a message fault if the difference between said instant current signature to a plurality of preset fault signatures exceed a preset threshold value.

3 Claims, 9 Drawing Sheets

HYBRID SCAVENGELESS DEVELOPMENT USING A FAILURE MODE DETECTION SYSTEM

This invention relates generally to a development apparatus used in ionographic or electrophotographic imaging and printing apparatuses and machines, and more particularly is directed to a failure mode detection system to be utilized with a developer system.

Generally, the process of electrophotographic printing includes charging a photoconductive member to a substantially uniform potential so as to sensitize the surface thereof. The charged portion of the photoconductive surface is exposed to a light image from either a scanning laser beam or an original document being reproduced. This records an electrostatic latent image on the photoconductive surface. After the electrostatic latent image is recorded on the photoconductive surface, the latent image is developed. Two component and single component developer materials are commonly used for development. A typical two component developer comprises magnetic carrier granules having toner particles adhering triboelectrically thereto. A single component developer material typically comprises toner particles. Toner particles are attracted to the latent image forming a toner powder image on the photoconductive surface, the toner powder image is subsequently transferred to a copy sheet, and finally, the toner powder image is heated to permanently fuse it to the copy sheet in image configuration.

The electrophotographic marking process given above can be modified to produce color images. One color electrophotographic marking process, called image-on-image processing, superimposes toner powder images of different color toners onto the photoreceptor prior to the transfer of the composite toner powder image onto the substrate. While the image on image process is beneficial, it has several problems. For example, when recharging the photoreceptor in preparation for creating another color toner powder image, it is important to level the voltages between the previously toned and the untoned areas of the photoreceptor. Moreover, the viability of printing system concepts such as image-on-image processing usually requires development systems that do not scavenge or interact with a previously developed image. Several known development systems, such as conventional magnetic brush development and jumping single component development, are interactive with the image bearing member, making them unsuitable for use with image-on-image processes.

Hybrid scavengeless development technology develops toner via a conventional magnetic brush onto the surface of a donor roll and a plurality of electrode wires are closely spaced from the toned donor roll in the development zone. An AC voltage is applied to the wires to generate a toner cloud in the development zone. This donor roll generally consists of a conductive core covered with a thin (50–200 $\mu$m) partially conductive layer. The magnetic brush roll is held at an electrical potential difference relative to the donor core to produce the field necessary for toner development. The toner layer on the donor roll is then disturbed by electric fields from a wire or set of wires to produce and sustain an agitated cloud of toner particles. Typical ac voltages of the wires relative to the donor are 600–900 Vpp at frequencies of 5–15 kHz. These ac signals are often square waves, rather than pure sinusoidal waves. Toner from the cloud is then developed onto the nearby photoreceptor by fields created by a latent image.

A problem with such developer systems is that the performance of the wires can fail for various reasons. For example, wire breakage, wire-to-roll arching, wire filming and etc. There is a need for a detection system to detect such problem and to implement the appropriate corrective action.

SUMMARY OF THE INVENTION

There is provided an apparatus for developing a latent image recorded on a surface, including a housing defining a chamber storing a supply of developer material comprising toner; a toner donor member spaced from the surface and being adapted to transport toner to a region opposed from the surface; means for conveying said developer material in the chamber of said housing onto said donor member; an electrode member spaced near the surface of a donor roll, said electrode member being electrically biased by a power supply to detach toner from said donor member as to form a toner cloud for developing the latent image; and a current signature analysis system, in communication with said power supply, for sampling an instant current signature being supplied from said electrode member; and a comparator, in communication with said current signature analysis system, for comparing said instant current signature to a plurality of preset fault signatures, said comparator including means for generating a message fault if the difference between said instant current signature to a plurality of preset fault signatures exceed a preset threshold value.

Inasmuch as the art of electrophotographic printing is well known, the various processing stations employed in the printing machine will be shown hereinafter schematically and their operation described briefly with reference thereto.

DETAILED DESCRIPTION OF THE PRESENT INVENTION

Figure 1:
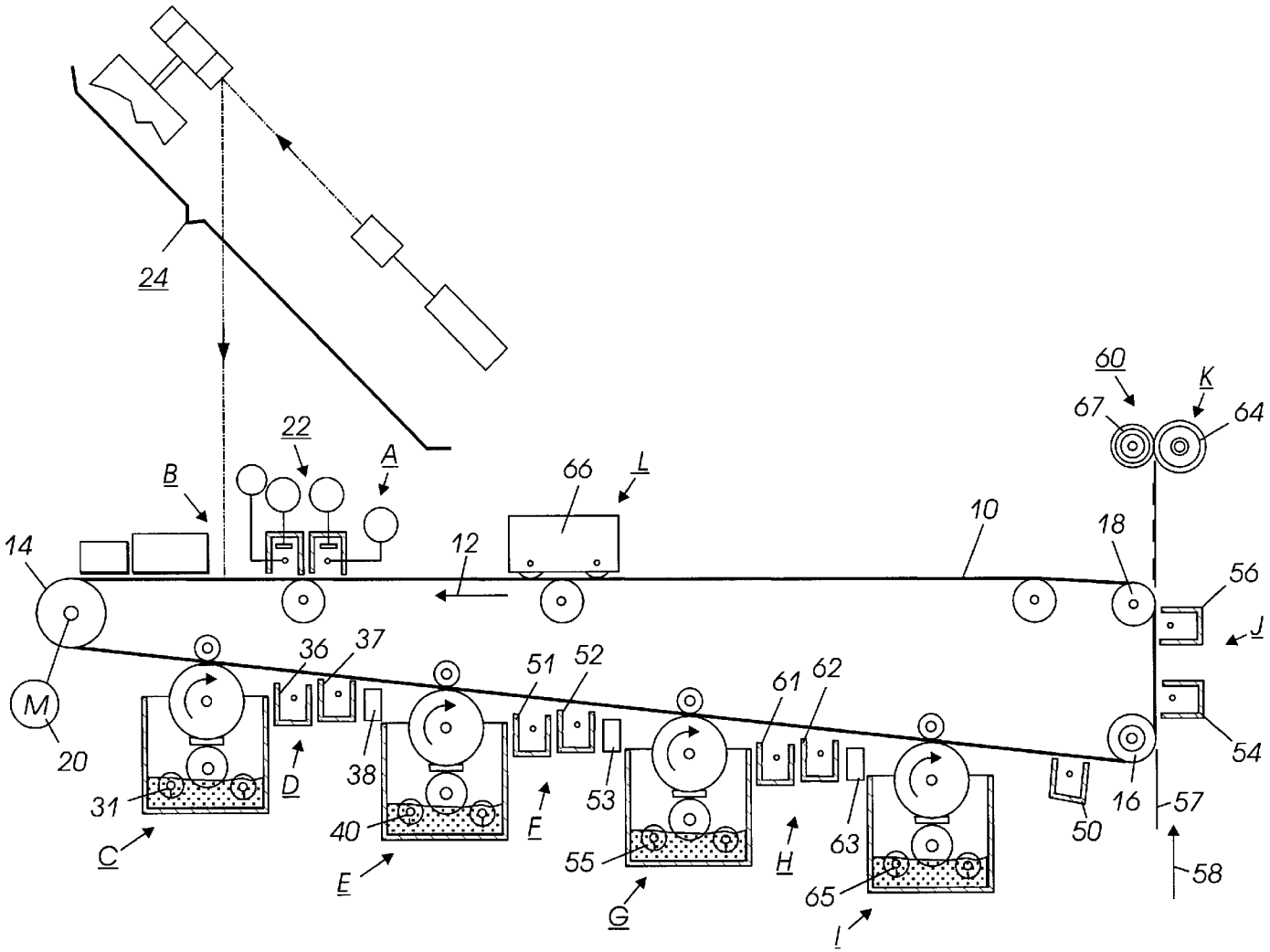
FIG. 1 is a schematic elevational view of an illustrative electrophotographic printing or imaging machine or apparatus incorporating a development apparatus having the features of the present invention therein.

Referring initially to FIG. 1, there is shown an illustrative electrophotographic machine having incorporated therein the development apparatus of the present invention. An electrophotographic printing machine creates a color image in a single pass through the machine and incorporates the features of the present invention. The printing machine uses a charge retentive surface in the form of an Active Matrix (AMAT) photoreceptor belt 10 which travels in the direction indicated by the arrow 12. Belt travel is brought about by mounting the belt about a drive roller 14 and two tension rollers 16 and 18 and then rotating the drive roller 14 via a drive motor 20.

As the photoreceptor belt moves, each part of it passes through each of the subsequently described process stations. For convenience, a single section of the photoreceptor belt, referred to as the image area, is identified. The image area is that part of the photoreceptor belt which is to receive the toner powder images that, after being transferred to a substrate, produce the final image. While the photoreceptor belt may have numerous image areas, since each image area is processed in the same way, a description of the typical processing of one image area suffices to fully explain the operation of the printing machine.

Figure 2:
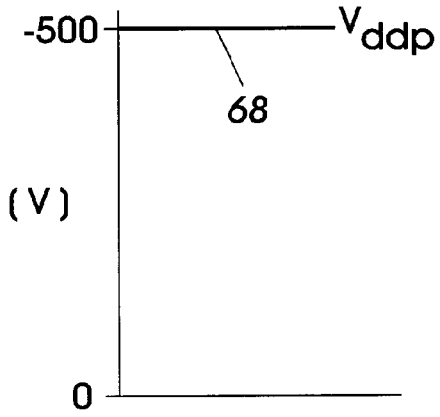
FIG. 2 shows a typical voltage profile of an image area in the electrophotographic printing machines illustrated in FIG. 1 after that image area has been charged.

As the photoreceptor belt 10 moves, the image area passes through a charging station A. At charging station A, a corona generating device, indicated generally by the reference numeral 22, charges the image area to a relatively high and substantially uniform potential. FIG. 2 illustrates a typical voltage profile 68 of an image area after that image area has left the charging station A. As shown, the image area has a uniform potential of about −500 volts. In practice, this is accomplished by charging the image area slightly more negative than −500 volts so that any resulting dark decay reduces the voltage to the desired −500 volts. While FIG. 2 shows the image area as being negatively charged, it could be positively charged if the charge levels and polarities of the toners, recharging devices, photoreceptor, and other relevant regions or devices are appropriately changed.

Figure 3:
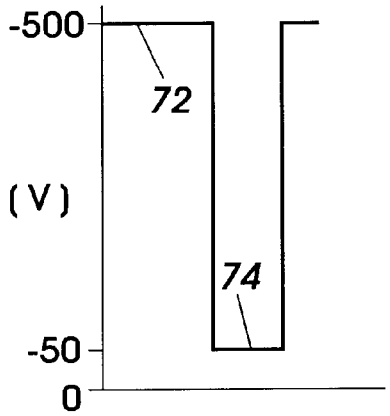
FIG. 3 shows a typical voltage profile of the image area after being exposed.

After passing through the charging station A, the now charged image area passes through a first exposure station B. At exposure station B, the charged image area is exposed to light which illuminates the image area with a light representation of a first color (say black) image. That light representation discharges some parts of the image area so as to create an electrostatic latent image. While the illustrated embodiment uses a laser-based output scanning device 24 as a light source, it is to be understood that other light sources, for example an LED printbar, can also be used with the principles of the present invention. FIG. 3 shows typical voltage levels, the levels 72 and 74, which might exist on the image area after exposure. The voltage level 72, about −500 volts, exists on those parts of the image area which were not illuminated, while the voltage level 74, about −50 volts, exists on those parts which were illuminated. Thus after exposure, the image area has a voltage profile comprised of relative high and low voltages.

After passing through the first exposure station B, the now exposed image area passes through a first development station C which is identical in structure with development system E, G, and I. The first development station C deposits a first color, say black, of negatively charged toner 31 onto the image area. That toner is attracted to the less negative sections of the image area and repelled by the more negative sections. The result is a first toner powder image on the image area. It should be understood that one could also use positively charged toner if the exposed and unexposed areas of the photoreceptor are interchanged, or if the charging polarity of the photoreceptor is made positive.

Figure 8:
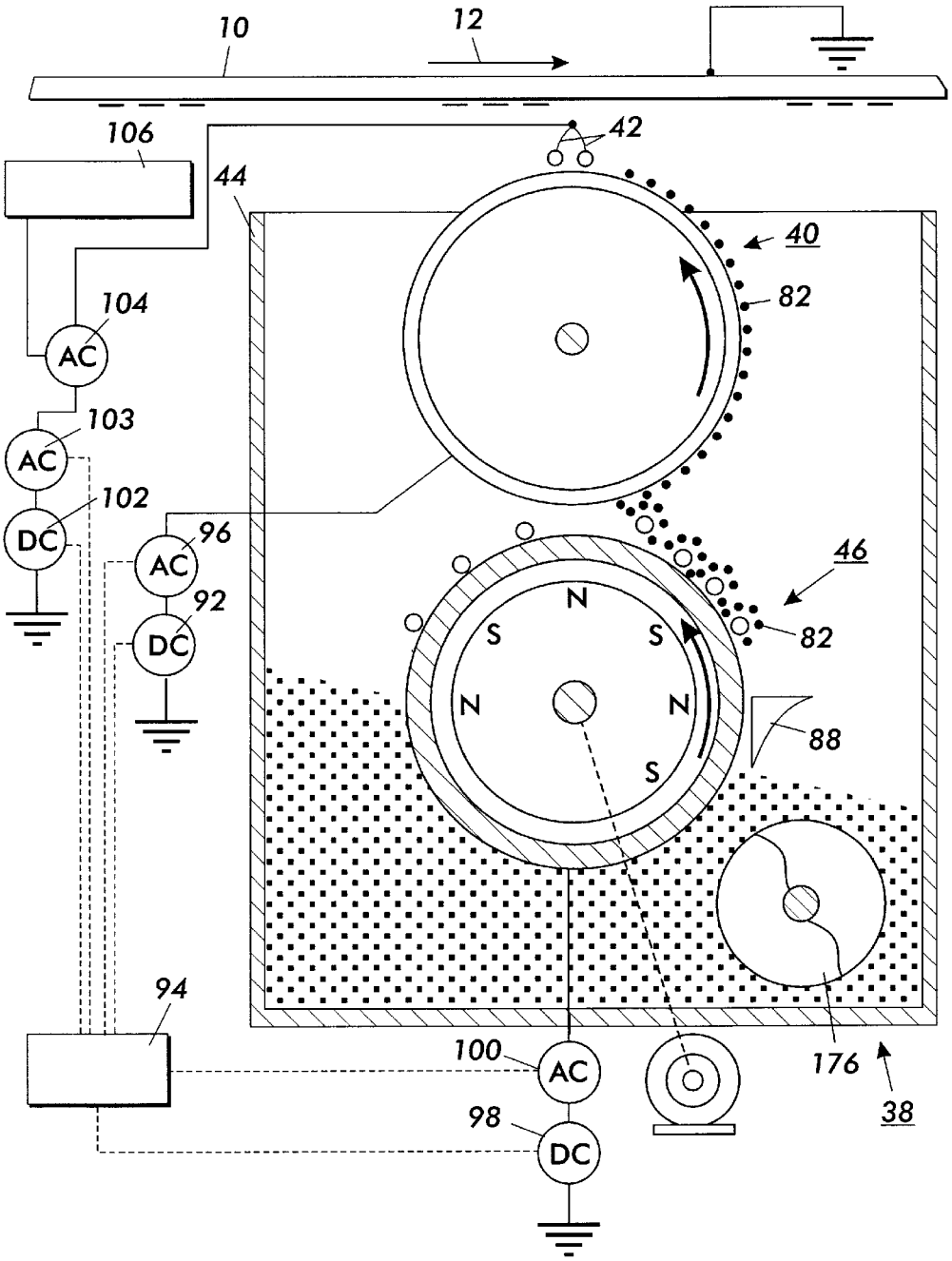
FIG. 8 is a schematic elevational view showing the development apparatus used in the FIG. 1 printing machine.

For the first development station C, development system includes a donor roll. As illustrated in FIG. 8, electrode grid 42 is electrically biased with an AC voltage relative to donor roll 40 for the purpose of detaching toner therefrom. This detached toner forms a toner powder cloud in the gap between the donor roll and photoconductive surface. Both electrode grid 42 and donor roll 40 are biased with DC sources 102 and 92 respectively for discharge area development (DAD). The discharged photoreceptor image attracts toner particles from the toner powder cloud to form a toner powder image thereon.

Figure 4:
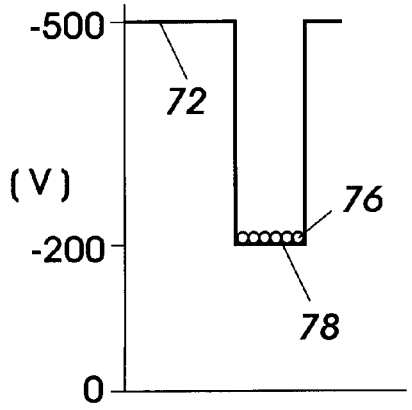
FIG. 4 shows a typical voltage profile of the image area after being developed.

FIG. 4 shows the voltages on the image area after the image area passes through the first development station C. Toner 76 (which generally represents any color of toner) adheres to the illuminated image area. This causes the voltage in the illuminated area to increase to, for example, about −200 volts, as represented by the solid line 78. The unilluminated parts of the image area remain at about the level −500 72.

Referring back to FIG. 1, after passing through the first development station C, the now exposed and toned image area passes to a first recharging station D. The recharging station D is comprised of two corona recharging devices, a first recharging device 36 and a second recharging device 37. These devices act together to recharge the voltage levels of both the toned and untoned parts of the image area to a substantially uniform level. It is to be understood that power supplies are coupled to the first and second recharging devices 36 and 37, and to any grid or other voltage control surface associated therewith, so that the necessary electrical inputs are available for the recharging devices to accomplish their task.

Figure 5:
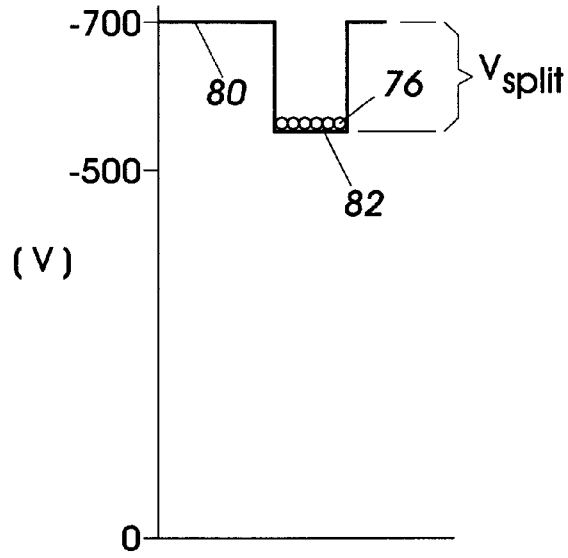
FIG. 5 shows a typical voltage profile of the image area after being recharged by a first recharging device.

FIG. 5 shows the voltages on the image area after it passes through the first recharging device 36. The first recharging device overcharges the image area to more negative levels than that which the image area is to have when it leaves the recharging station D. For example, as shown in FIG. 5 the toned and the untoned parts of the image area, reach a voltage level 80 of about −700 volts. The first recharging device 36 is preferably a DC scorotron.

Figure 6:
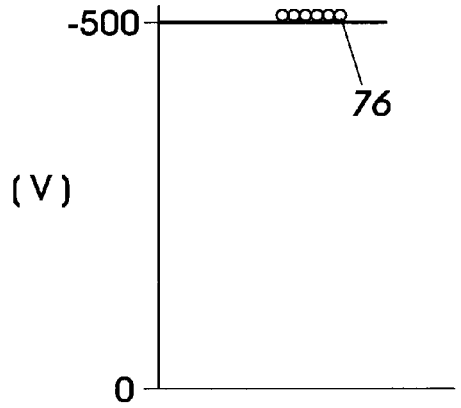
FIG. 6 shows a typical voltage profile of the image area after being recharged by a second recharging device.

After being recharged by the first recharging device 36, the image area passes to the second recharging device 37. Referring now to FIG. 6, the second recharging device 37 reduces the voltage of the image area, both the untoned parts and the toned parts (represented by toner 76) to a level 84 which is the desired potential of −500 volts.

Figure 7:
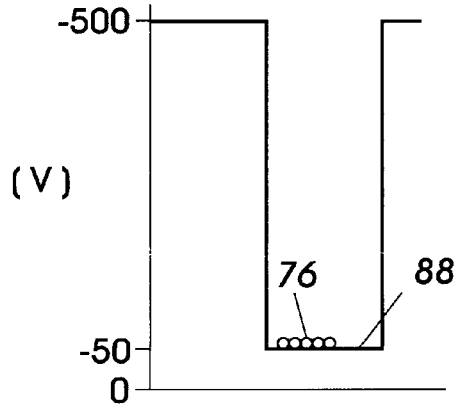
FIG. 7 shows a typical voltage profile of the image area after being exposed for a second time.

After being recharged at the first recharging station D, the now substantially uniformly charged image area with its first toner powder image passes to a second exposure station 38. Except for the fact that the second exposure station illuminates the image area with a light representation of a second color image (say yellow) to create a second electrostatic latent image, the second exposure station 38 is the same as the first exposure station B. FIG. 7 illustrates the potentials on the image area after it passes through the second exposure station. As shown, the non-illuminated areas have a potential about −500 as denoted by the level 84. However, illuminated areas, both the previously toned areas denoted by the toner 76 and the untoned areas are discharged to about −50 volts as denoted by the level 88.

The image area then passes to a second development station E. Except for the fact that the second development station E contains a toner 40 which is of a different color (yellow) than the toner 31 (black) in the first development station C, the second development station is substantially the same as the first development station. Since the toner 40 is attracted to the less negative parts of the image area and repelled by the more negative parts, after passing through the second development station E the image area has first and second toner powder images which may overlap.

The image area then passes to a second recharging station F. The second recharging station F has first and second recharging devices, the devices 51 and 52, respectively, which operate similar to the recharging devices 36 and 37. Briefly, the first corona recharge device 51 overcharges the image areas to a greater absolute potential than that ultimately desired (say −700 volts) and the second corona recharging device, comprised of coronodes having AC potentials, neutralizes that potential to that ultimately desired.

The now recharged image area then passes through a third exposure station 53. Except for the fact that the third exposure station illuminates the image area with a light representation of a third color image (say magenta) so as to create a third electrostatic latent image, the third exposure station 38 is the same as the first and second exposure stations B and 38. The third electrostatic latent image is then developed using a third color of toner 55 (magenta) contained in a third development station G.

The now recharged image area then passes through a third recharging station H. The third recharging station includes a pair of corona recharge devices 61 and 62 which adjust the voltage level of both the toned and untoned parts of the image area to a substantially uniform level in a manner similar to the corona recharging devices 36 and 37 and recharging devices 51 and 52.

After passing through the third recharging station the now recharged image area then passes through a fourth exposure station 63. Except for the fact that the fourth exposure station illuminates the image area with a light representation of a fourth color image (say cyan) so as to create a fourth electrostatic latent image, the fourth exposure station 63 is the same as the first, second, and third exposure stations, the exposure stations B, 38, and 53, respectively. The fourth electrostatic latent image is then developed using a fourth color toner 65 (cyan) contained in a fourth development station I.

To condition the toner for effective transfer to a substrate, the image area then passes to a pretransfer corotron member 50 which delivers corona charge to ensure that the toner particles are of the required charge level so as to ensure proper subsequent transfer.

After passing the corotron member 50, the four toner powder images are transferred from the image area onto a support sheet 57 at transfer station J. It is to be understood that the support sheet is advanced to the transfer station in the direction 58 by a conventional sheet feeding apparatus which is not shown. The transfer station J includes a transfer corona device 54 which sprays positive ions onto the backside of sheet 57. This causes the negatively charged toner powder images to move onto the support sheet 57. The transfer station J also includes a detack corona device 56 which facilitates the removal of the support sheet 52 from the printing machine.

After transfer, the support sheet 57 moves onto a conveyor (not shown) which advances that sheet to a fusing station K. The fusing station K includes a fuser assembly, indicated generally by the reference numeral 60, which permanently affixes the transferred powder image to the support sheet 57. Preferably, the fuser assembly 60 includes a heated fuser roller 67 and a backup or pressure roller 64. When the support sheet 57 passes between the fuser roller 67 and the backup roller 64 the toner powder is permanently affixed to the sheet support 57. After fusing, a chute, not shown, guides the support sheets 57 to a catch tray, also not shown, for removal by an operator.

After the support sheet 57 has separated from the photoreceptor belt 10, residual toner particles on the image area are removed at cleaning station L via a cleaning brush contained in a housing 66. The image area is then ready to begin a new marking cycle.

The various machine functions described above are generally managed and regulated by a controller which provides electrical command signals for controlling the operations described above.

Referring now to FIG. 8 in greater detail, development system 38 includes a donor roll 40. A development apparatus advances developer materials into development zones. The development system 38 is scavengeless. By scavengeless is meant that the developer or toner of system 38 must not interact with an image already formed on the image receiver. Thus, the system 38 is also known as a non-interactive development system. The development system 38 comprises a donor structure in the form of a roller 40. The donor structure 40 conveys a toner layer to the development zone which is the area between the member 10 and the donor structure 40. The toner layer 82 can be formed on the donor 40 by either a two-component developer (i.e. toner and carrier), as shown in FIG. 8, or a single-component developer deposited on member 40 via a combination single-component toner metering and charging device. The development zone contains an AC biased electrode structure 42 self-spaced from the donor roll 40 by the toner layer. The single-component toner may comprise positively or negatively charged toner.

For donor roll loading with two-component developer, a conventional magnetic brush 46 is used for depositing the toner layer onto the donor structure. The magnetic brush includes a magnetic core enclosed by a sleeve 86.

With continued reference to FIG. 8, auger 176, is located in housing 44. Auger 176 is mounted rotatably to mix and transport developer material. The augers have blades extending spirally outwardly from a shaft. The blades are designed to advance the developer material in the axial direction substantially parallel to the longitudinal axis of the shaft. The developer metering device is designated 88. As successive electrostatic latent images are developed, the toner particles within the developer material are depleted. A toner dispenser (not shown) stores a supply of toner particles. The toner dispenser is in communication with housing 44. As the concentration of toner particles in the developer material is decreased, fresh toner particles are furnished to the developer material in the chamber from the toner dispenser. The augers in the chamber of the housing mix the fresh toner particles with the remaining developer material so that the resultant developer material therein is substantially uniform with the concentration of toner particles being optimized. In this manner, a substantially constant amount of toner particles are maintained in the chamber of the developer housing.

The electrode structure 42 is comprised of one or more thin (i.e. 50 to 100 microns diameter) conductive wires which are lightly positioned against the toner on the donor structure 40. The distance between the wires and the donor is self-spaced by the thickness of the toner layer, which is approximately 15 microns. The extremities of the wires are supported by blocks (not shown) at points slightly above a tangent to the donor roll surface. A suitable scavengeless development system for incorporation in the present invention is disclosed in U.S. Pat. No. 4,868,600 and is incorporated herein by reference. As disclosed in the '600 patent, a scavengeless development system may be conditioned to selectively develop one or the other of the two image areas (i.e. discharged and charged image areas) by the application of appropriate AC and DC voltage biases to the wires 42 and the donor roll structure 40.

According to the present invention, and referring again to FIG. 8, the developer unit preferably includes a DC voltage source 102 to provide proper bias to the wires 42 relative to the donor roller 40. The invention may nonetheless operate with some success without the DC voltage source 102. The wires 42 receive AC voltages from sources 103 and 104. These sources may generate different frequencies, and the resultant voltage on the wire is the instantaneous sum of the AC sources 103 and 104 plus the DC source 102. AC source 103 is often chosen to have the same frequency, magnitude, and phase as AC source 96, which supplies the donor roll 40. Then, the voltage of the wires with respect to the donor roll is just the AC source 104 plus the DC source 102. AC voltage source 104 is connected to a modulator 106 for modulating its frequency. The modulated frequency alternating current signal from the source 104 is electrically connected to the wires 42. If the source 104 has a frequency output that can be controlled by an external voltage, the modulator 106 may be any suitable commercially available suitable device, such as one including a frequency generator.

While in the development system 38, as shown in FIG. 8, the AC voltage sources 104 and 103 and the DC voltage source 102 receive their power from the power supply 94, the power may likewise be received from separate power supplies. Also, the DC voltage source 102 may be separate from the DC voltage sources 92 and 98 as shown in FIG. 8 or share a common voltage source. Further, the AC voltage source 104 may be separate from the AC voltage sources 96, 103, and 100 as shown in FIG. 8 or share a common voltage source. Also, modulator 106 may merely modulate the signal from the AC voltage source 104 as shown in FIG. 8 or modulate any of the AC voltage sources 96, 103, or 100.

The electrical sections of FIG. 8 are schematic in nature. Those skilled in the art of electronic circuits will realize there are many possible ways to connect AC and DC voltage sources to achieve the desired voltages on electrodes 42, donor roll 40, and magnetic brush roll 46.

Figure 9:
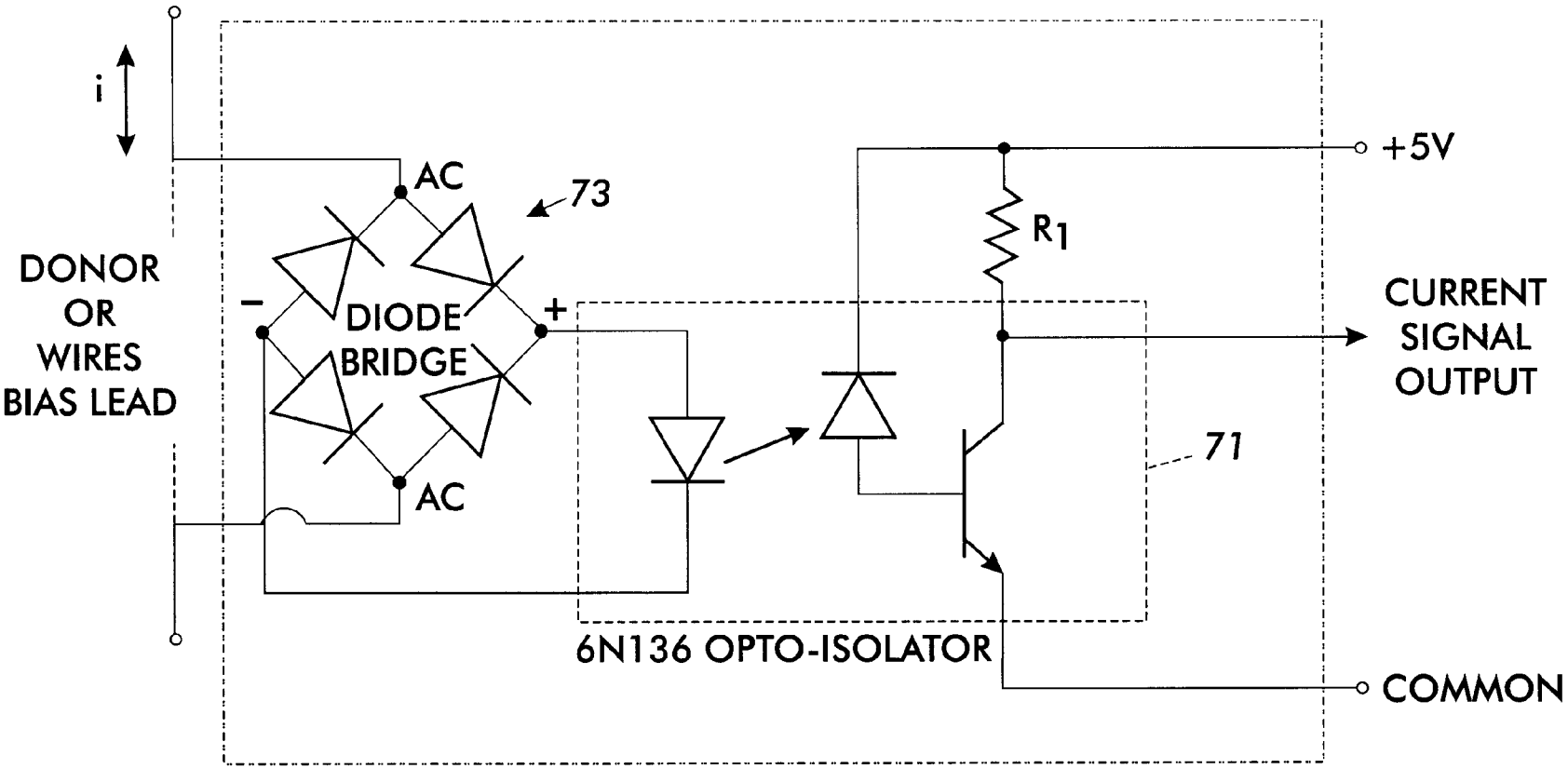
FIG. 9 is a schematic diagram of a circuit that can detect the AC current flowing in the electrode grid 42 or donor roll 40 bias wires, and convert this signal to a ground referenced DC level.
Figure 16:
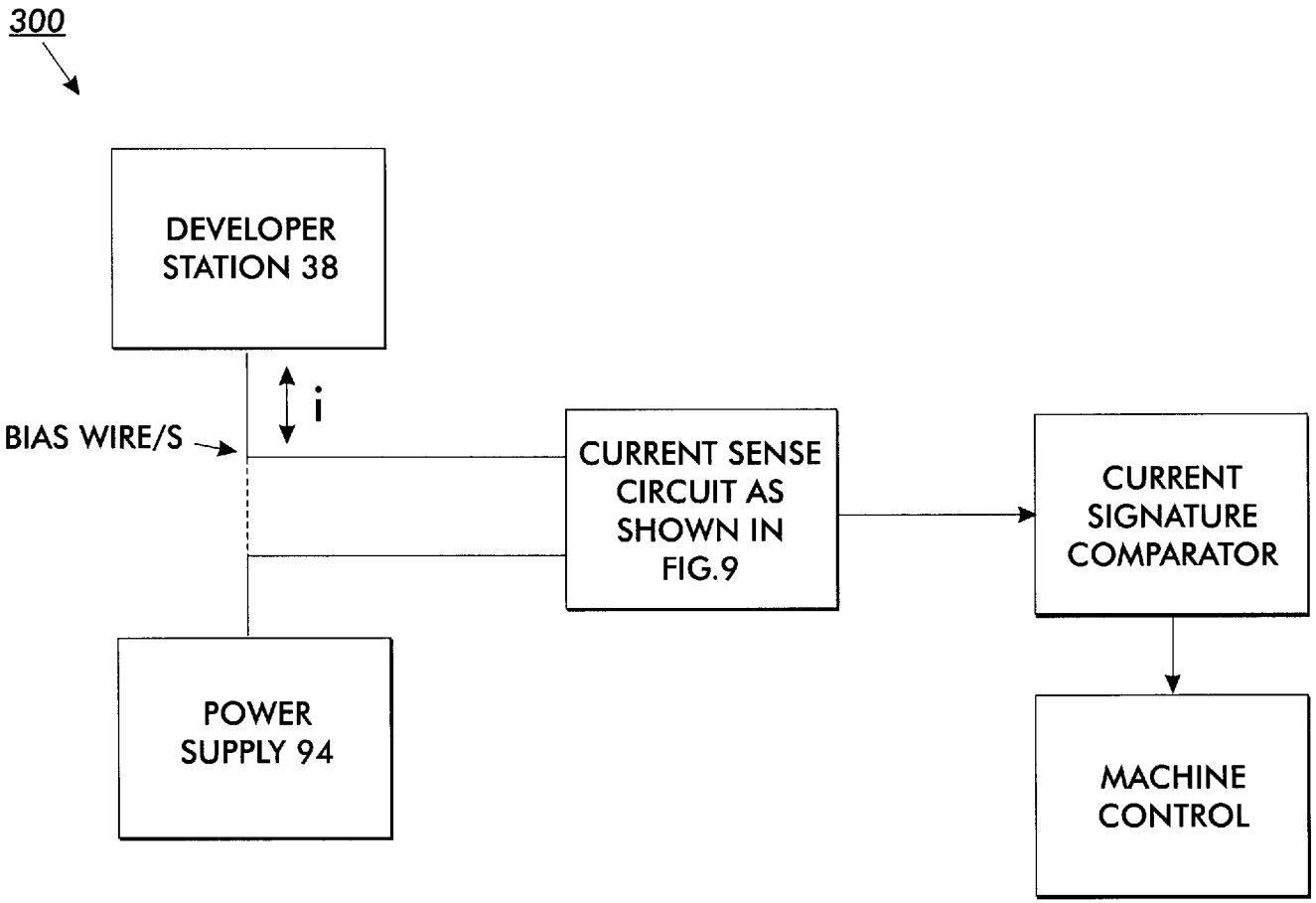
FIG. 16 illustrates a block diagram of the current signature analysis system of the present invention.

The current analysis system of the present invention samples the current signature during developer operation and compares it to a preset current level which indicate faults within the developer unit. A fault signal is generated when the current signature exceeds a preset percentage change (either higher or lower) from a running average of the current signature. The current analysis system 300 (as shown in FIG. 16) includes a means to monitor the AC current flowing in the circuit of interest and a means to detect changes in that current. One method of detecting the AC current flow is shown in FIG. 9. The AC current to be measured is rectified through diode bridge 73 and then passes through the emitter of opto-isolator 71. The output current of the opto-isolator will generate a voltage across R1 that is proportional to the current flowing in the emitter. This sensed current signature (voltage) can then be compared against a reference voltage (not shown) to detect failures. The Reference may be a fixed high and or low threshold value or it may be a fixed percentage change of a running average of the current signature or it may be analyzed by a microprocessor for more complex functions.

Figure 10:
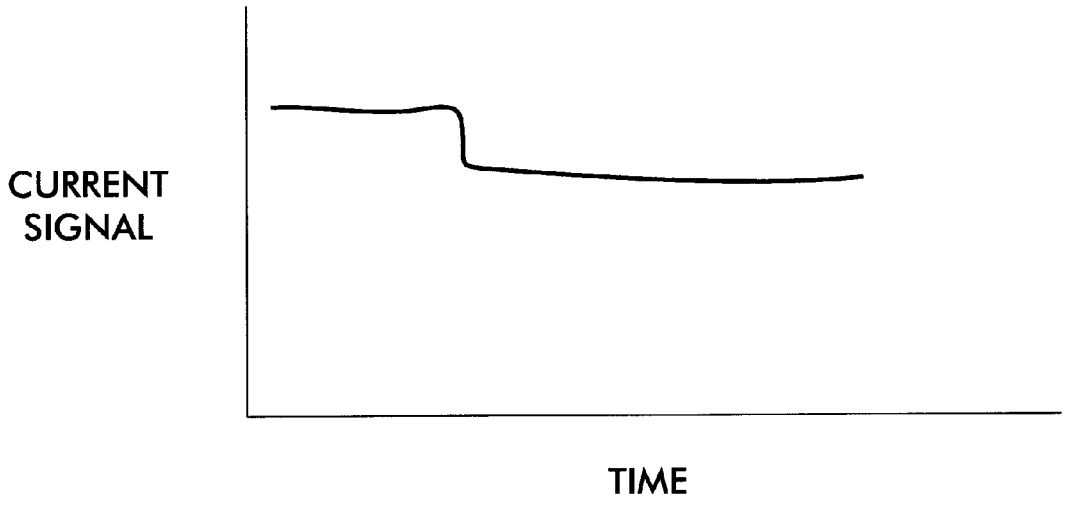
FIGS. 10–15 illustrates some of the wire signatures in which the present invention can detect.

Now referring to FIGS. 10–15, The following are examples of possible signatures the present invention can detect and possible corrective action to be taken. FIG. 10 illustrates wire breakage in which the wire signature is characterized by a sudden drop in wire current, possible corrective action for this fault includes a hard stop of the machine, logging of the fault for that development station, informing operator to replace the wire/s or to call a service representative.

Figure 11:
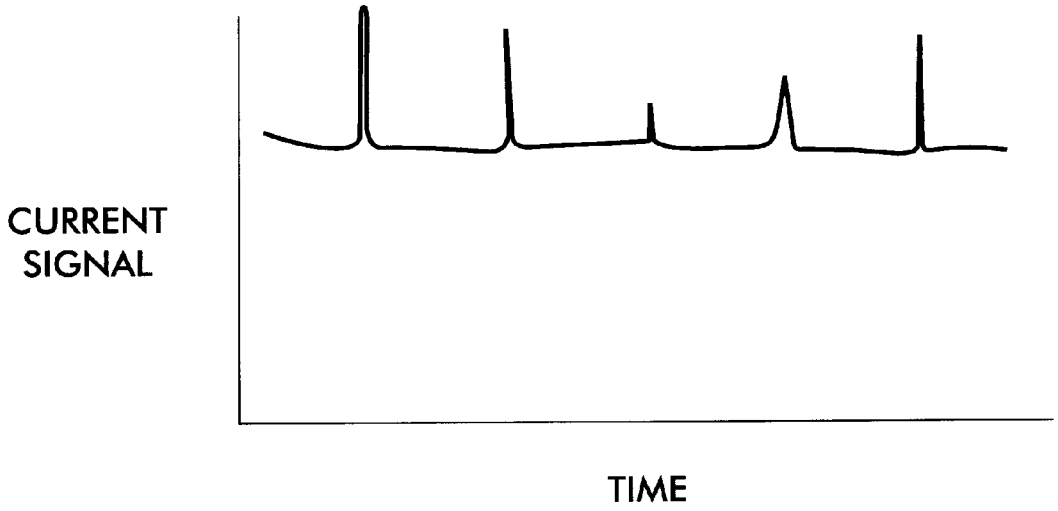

FIG. 11 illustrates wire to roll or wire to P/R arcing or shorting in which the wire signature is characterized by a sudden increase in current with high frequency components, again corrective action could include a hard stop of the machine, logging fault, inform operator to call service representative.

Figure 12:
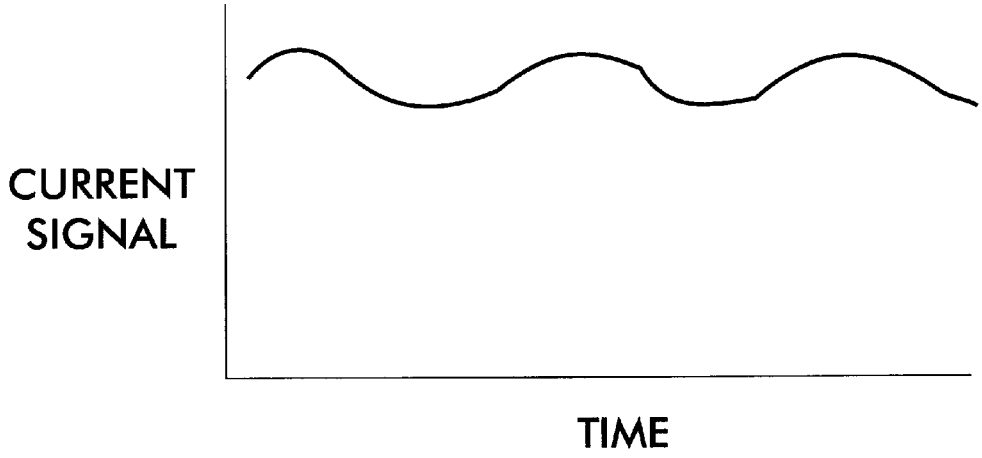
Figure 13:
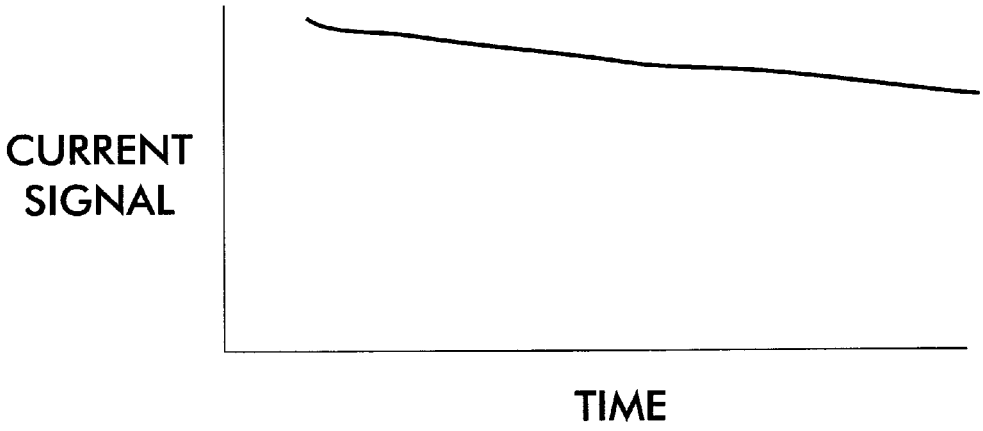

FIG. 12 illustrates once-around donor thickness variation in which the wire signature is characterized by a gradual variation at the donor rotation frequency, possible corrective action for this fault includes logging of the fault with possible, service representative investigation at the next scheduled maintenance. FIG. 13 illustrates wire filming or contamination in which the wire signature is characterized by a gradual decrease, possible corrective action for this fault includes logging of the fault, with, service representative investigation at the next scheduled maintenance.

Figure 14:
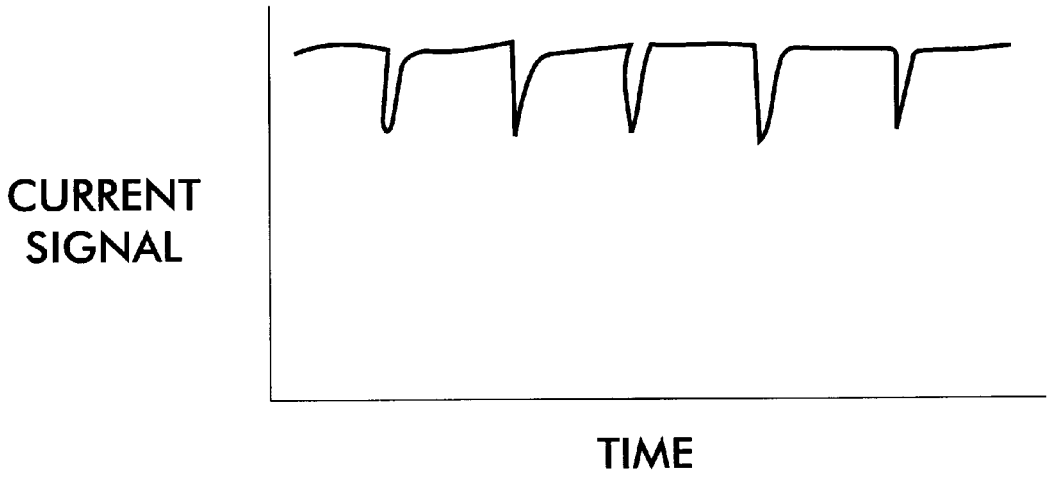

FIG. 14 illustrates donor filming in which the wire signature is characterized by a periodic variation at donor rotation frequency with possible long term gradual decrease, possible corrective action for this fault includes logging the fault if outside acceptable tolerance, with further investigation of the cause at the next scheduled maintenance.

Figure 15:
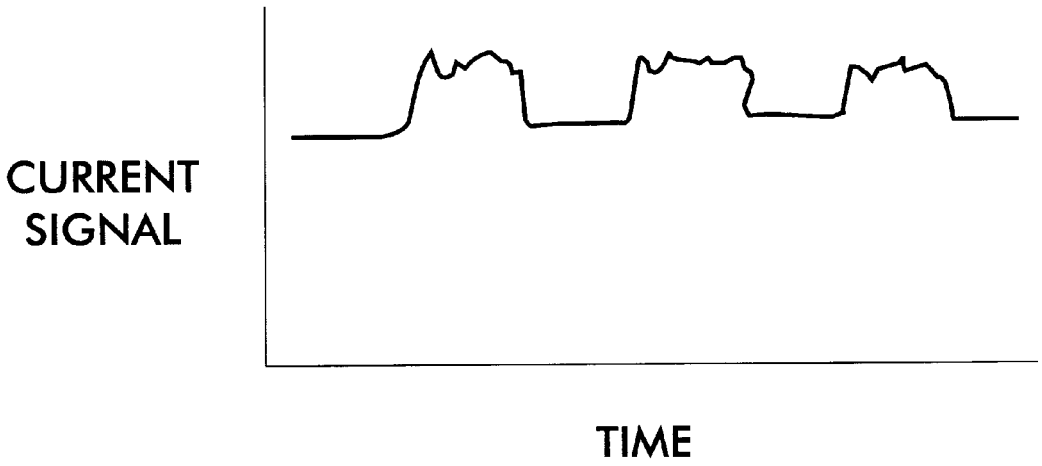

FIG. 15 illustrates development problems in which the wire signature is characterized by a periodic increase due to a loss of toner layer spacing the wire electrodes, possible corrective action for this fault include logging the fault if outside acceptable tolerance, and investigating the cause at next scheduled maintenance.

Other embodiments and modifications of the present invention may occur to those skilled in the art subsequent to a review of the information presented herein; these embodiments and modifications, as well as equivalents thereof, are also included within the scope of this invention.

What is claimed is:

1. An apparatus for developing a latent image recorded on a surface, comprising:

a housing defining a chamber storing a supply of developer material comprising toner;

a toner donor member spaced from the surface and being adapted to transport toner to a region opposed from the surface;

means for conveying said developer material in the chamber of said housing onto said donor member;

an electrode member spaced near the surface of a donor roll, said electrode member; a power supply electrically biasing said electrode member to detach toner from said donor member as to form a toner cloud for developing the latent image; and a current signature analysis system, in communication with said power supply, for sampling the current signature going through said electrode member; and a comparator, in communication with said current signature analysis system, for comparing said current signature to a plurality of preset fault signatures, said comparator including means for generating a message fault, said generating means generates said message fault if the difference between said instant current signature to said plurality of preset fault signatures exceed a preset threshold value.

2. The apparatus of claim 1, further comprising means, responsive to said message fault, for stopping the operation of said apparatus.

3. A method for detecting faults in a developer system including a housing defining a chamber storing a supply of developer material comprising toner; a toner donor member spaced from the surface and being adapted to transport toner to a region opposed from the surface; means for conveying said developer material in the chamber of said housing onto said donor member; an electrode member spaced near the surface of a donor roll, said electrode member being electrically biased by a power supply to detach toner from said donor member as to form a toner cloud for developing the latent image, the method comprising the steps of:

sampling a current signature going through said electrode member;

comparing said current signature to a plurality of preset fault signatures;

said comparing step includes the step of generating a message fault, if the difference between said instant current signature to the plurality of preset fault signatures exceed a preset threshold value.

* * * * *